US010597916B2

(12) United States Patent
Zaccaria

(10) Patent No.: US 10,597,916 B2
(45) Date of Patent: Mar. 24, 2020

(54) CORNER DEFLECTION MEANS OF A FITTING FOR A WINDOW CASEMENT OR A DOOR LEAF

(71) Applicants: WILH. SCHLECHTENDAHL & SÖHNE GMBH & CO. KG (WSS), Heiligenhaus (DE); SAPA AS, Oslo (NO)

(72) Inventor: Giovanni Zaccaria, Leinfelden Echterdingen (DE)

(73) Assignees: WILH. SCHLECHTENDAHL & SÖHNE GMBH & CO. KG (WSS), Heiligenhaus (DE); SAPA AS, Oslo (NO)

( * ) Notice: Subject to any disclaimer, the term of this patent is extended or adjusted under 35 U.S.C. 154(b) by 128 days.

(21) Appl. No.: 15/641,263

(22) Filed: Jul. 4, 2017

(65) Prior Publication Data

US 2018/0010371 A1 Jan. 11, 2018

(51) Int. Cl.

| | |
|---|---|
| ***E06B 3/00*** | (2006.01) |
| ***E05C 9/24*** | (2006.01) |
| ***E05D 5/02*** | (2006.01) |
| ***E05F 7/08*** | (2006.01) |
| ***E05C 9/00*** | (2006.01) |
| ***E05C 9/20*** | (2006.01) |
| ***E05C 9/22*** | (2006.01) |

(52) U.S. Cl.

CPC ..... *E05C 9/24* (2013.01); *E05C 9/006* (2013.01); *E05C 9/20* (2013.01); *E05C 9/22* (2013.01); *E05D 5/0238* (2013.01); *E05F 7/08* (2013.01)

(58) Field of Classification Search

CPC ..... E05D 5/0238; E05Y 2800/689; E06B 2003/6223; E06B 2003/6226; E05C 9/006; E05C 9/20; E05C 9/24; E05C 9/22

USPC ..... 49/503, 246, 248

See application file for complete search history.

(56) References Cited

U.S. PATENT DOCUMENTS

| | | | | |
|---|---|---|---|---|
| 4,637,165 | A * | 1/1987 | Schneider | E05D 15/5208 49/192 |
| 9,512,658 | B2 * | 12/2016 | Balbo Di Vinadio | E05D 15/44 |
| 10,012,016 | B2 * | 7/2018 | Li | E05D 15/02 |
| 2005/0022941 | A1 * | 2/2005 | Di Vinadio | E05C 9/20 160/15 |
| 2005/0246979 | A1 * | 11/2005 | Balbo Di Vinadio | E05D 15/5208 52/204.1 |
| 2007/0180771 | A1 * | 8/2007 | Salzer | E05B 17/2084 49/246 |

(Continued)

*Primary Examiner* — Chi Q Nguyen

(74) *Attorney, Agent, or Firm* — Im IP Law; Chai Im; C. Andrew Im

(57) ABSTRACT

A corner deflector of a fitting for a window casement or a door leaf, insertable into a C-shaped casement/leaf groove in the rebate of a frame profile of the casement/leaf. The corner deflector having a first corner limb and a second corner limb at right angles to the first corner limb. A groove for a limb of the casement/leaf groove, the limb groove having an undercut, is provided on a first longitudinal side of the first corner limb and/or of the second corner limb. The region of the second longitudinal side of the first and/or second corner limb which is located opposite the undercut of the first longitudinal side is undercut-free. At least one securing element is provided on the second longitudinal side, which can be moved relative to the second longitudinal side between a securing position and a disengagement position.

17 Claims, 17 Drawing Sheets

(56) References Cited

U.S. PATENT DOCUMENTS

2008/0016774 A1* 1/2008 Vinadio ..... E05C 9/063
49/192

* cited by examiner

CORNER DEFLECTION MEANS OF A FITTING FOR A WINDOW CASEMENT OR A DOOR LEAF

RELATED APPLICATIONS

This application claims priority from European Patent Application No. 16 001 503.8 tiled Jul. 4, 2016, which is herein incorporated by reference in its entirety.

FIELD OF THE INVENTION

The invention relates to a corner deflection means of a fitting for a window casement or a door leaf, for insertion into a C-shaped casement/leaf groove in the rebate of a frame profile of the casement/leaf, having a first corner limb and a second corner limb, which runs at right angles to the first corner limb, of a main body, wherein a groove for a limb of the casement/leaf groove, said limb groove having an undercut, is provided on a first longitudinal side of the first corner limb and/or of the second corner limb. The present invention also relates to a casement/leaf arrangement having a window casement or a door leaf, having a frame profile for the casement/leaf, said frame profile comprising a C-shaped casement/leaf groove with a first groove portion with a groove limb and/or a second groove portion with a groove limb in the rebate, and having at least one corner deflection means of the type mentioned above. Finally, the invention relates to a method of installing a corner deflection means of the type mentioned above in a C-shaped casement/leaf groove in the rebate of a frame profile of a window casement or of a door leaf.

BACKGROUND OF THE INVENTION

Fittings are used in order to actuate a window casement or a door leaf. A fitting here covers all the fitting parts which are installed in the rebate of the casement/leaf and are coupled to the fitting-gear mechanism. The fitting-gear mechanism is connected to a rotary handle which is provided on the outside of the casement/leaf and via which the individual fitting parts are actuated. The fitting parts are, for example, closing mechanisms, drive rods, tilt-locking devices, corner deflection means or scissor mechanisms, in particular rotary/tilt scissor mechanisms and/or the guides thereof. The respective fitting parts here are arranged in the rebate of the frame of the respective casement/leaf For this purpose, the frame profile of the casement/leaf has, in the rebate, a C-shaped groove, in which the individual fitting parts are arranged usually in a displaceable manner and are ultimately connected to the fitting-gear mechanism.

There are two different installation options for installing the fitting parts. One option provides for the individual fitting parts to be pushed on the end side into the open-ended C-shaped casement/leaf groove of the frame profile, The disadvantage with end-side installation is, in particular, that it is often difficult, in the case of a fitting part having to be changed over, to carry out a changeover when the casement/leaf is in the installed state.

Another installation principle is constituted by frontal installation. It is possible here for the individual fitting parts to be inserted frontally into the opening of the C-shaped casement/leaf groove in the rebate of the frame profile of the casement/leaf. However, systems known from practice that make use of the frontal-installation principle require a comparatively large number of components. This means that frontal installation involves comparatively high outlay.

It is usually the case that the installation of corner deflection means is particularly problematic. A corner deflection means is an angular fitting part which has two corner limbs running at right angles to one another. The corner deflection means serves the purpose of transmitting movements of the fitting around corners. For this purpose, the corner deflection means usually has an angled main body, wherein each corner limb has provided on it a movable connection part for connecting to a drive rod. The connection parts are connected to one another usually via at least one spring plate or at least one leaf spring, so that shear forces and tensile forces can be transmitted around corners.

The angular design means that it is usually problematic, and not straightforward, to install and remove a corner deflection means in the corner region of a casement/leaf.

OBJECT AND SUMMARY OF THE INVENTION

It is an object of the invention, then, to provide a corner deflection means of the type mentioned in the introduction which can be installed and removed in a straightforward manner.

The aforementioned object is achieved according to the invention, in the case of the corner deflection means of the type mentioned in the introduction, essentially in that that region of the second longitudinal side of the first and/or of the second corner limb which is located opposite the undercut of the first longitudinal side is undercut-free, and in that the second longitudinal side has provided on it at least one securing means, which can be moved relative to the second longitudinal side between a securing position and a disengagement position. The method of installing the aforementioned corner deflection means according to the invention in the C-shaped casement/leaf groove in the rebate of the frame profile of the window casement or of the door leaf makes provision for the corner deflection means first of all to have its two corner limbs inserted, in particular frontally, into the casement/leaf groove. Frontal insertion here means that first of all the one corner limb and then the other corner limb are inserted into the casement/leaf groove. It is also possible, however, for the corner deflection means to have its two corner limbs inserted simultaneously into the casement/leaf groove. This is possible because, as far as the casement/leaf arrangement is concerned, the width of the groove opening is greater than or equal to the distance between the two longitudinal sides in the region of the undercut. Since there is no effective undercut in the region of the second longitudinal side, the corner deflection means can readily have its two corner limbs inserted into the casement/leaf groove. As soon as insertion is complete, the corner deflection means is moved in the casement/leaf groove such that the undercut provided on the first longitudinal side engages behind the associated limb of the casement/leaf groove. The aforementioned movement gives rise to an interspace between the second longitudinal side of the corner limb and the groove limb of the adjacent portion of the casement/leaf groove. If the corner deflection means were left in this state, it would be possible, since only the undercut engages behind a groove limb, for the corner deflection means to be tilted out of the casement/leaf groove. In order to prevent this, and at the same time to secure the corner deflection means to a sufficient extent in the casement/leaf groove, the securing means is provided, said securing means being movable between the securing position and the disengagement position and, once the corner deflection means has been inserted into the casement/leaf groove, is moved from the disengagement position into the securing position in the interspace.

This results in the interspace being filled, and therefore the corner deflection means is fixed securely in the casement/leaf groove in the installed position.

It is particularly advantageous if the securing means is designed in the form of a pivotably mounted pivot lever with a securing portion which can be inserted into the interspace. The securing means here is retained preferably in captive fashion on the corner deflection means. The design in the form of a pivot lever makes it possible in a particularly straightforward manner during installation for the securing portion to be moved into the interspace between the casement/leaf groove and the second longitudinal side. The securing portion then at least essentially fills the aforementioned interspace. The pivot mounting also guarantees defined movements of the securing means.

For the purpose of realizing the pivotable mounting, it is particularly advantageous if the pivot lever is mounted pivotably in the corner region of the first and of the second corner limbs. The arrangement in the corner region is advantageous in two respects. On the one hand, the corner region has sufficient space to arrange the pivot-mounting means of the pivot lever. On the other hand, it is possible in principle, in the case of this arrangement, for the corner deflection means to be pushed onto the corner of the casement/leaf by one hand and, once the corner deflection means has been fully inserted into the casement/leaf groove, for the securing element to be pivoted from the disengagement position into the securing position.

In order to achieve a defined pivoting movement, it is also advantageous if the pivot lever has a stop for delimiting the pivoting movement. As soon as the stop strikes in particular against the front side of the associated corner limb of the corner deflection means, the pivot lever is located in the securing positon, which means that the securing portion is located in the interspace between the second longitudinal side and the associated limb of the casement/leaf groove. In order that the pivot lever, in the securing position, does not project unnecessarily beyond the front side of the associated corner limb, it is recommended in this context in particular for a mount for the stop to be provided on the front side of the corner limb, wherein the depth of the mount should correspond preferably to the thickness of the stop.

In order to avoid unintended disengagement of the securing means, a preferred configuration of the invention provides an arresting means for arresting the securing means in the securing position. The arresting means is preferably designed in the form of a latching connection which is easy to establish, but also to release again, manually.

For the purpose of coupling the corner deflection means according to the invention to further fining parts, provision is also made for the free end of the corner limb to have provided on it a connection body which is intended for the connection of a drive rod, and has a rear side and a front side. In order that the connection body does not obstruct the insertion of the corner deflection means into the casement/leaf groove, the distance between the outer sides of the connection body is smaller than or equal to the width of the opening of the casement/leaf groove.

The corner deflection means according to the invention is preferably part of a fitting system with a drive rod of particular design and/or further fitting parts. The drive rod here has a main body which is provided for inserting, to be precise specifically for pivoting, into the groove of the casement/leaf. The pivoting-in action is necessary since the width of the drive rod, at any rate in the region of the main body, is greater than the free opening of the casement/leaf groove. If the main body is pivoted into the casement/leaf groove, it is not usually possible for the main body to fall out of the groove. In the pivoted-in state, the main body, however, is not usually centred in the casement/leaf groove. This is because the casement/leaf groove ultimately has a greater width than the main body, and the main body is therefore arranged with play in the casement/leaf groove. The drive rod is shaped in a particular manner in order for the main body of the drive rod to be centred in the casement/leaf groove. According to the invention, the front side of the main body has provided on it two spaced-apart angled limbs, of which the free ends are directed towards one another. In this way, the main body and the angled limbs form an open-front C-shaped groove, which is provided in order for a further fining part to be inserted into the groove or in order for the connection body to be connected. The two angled limbs therefore ultimately provide a holder for arranging and fastening purposes.

In addition to the angled limbs, at least one longitudinal periphery has provided on it, preferably both longitudinal peripheries or sides have provided on them, a peripheral limb which projects on the front side and is intended for engaging behind a limb of the C-shaped casement/leaf groove. It is preferably the case here that the longitudinal periphery or the longitudinal side of the main body is angled in order to form the peripheral limb. The aforementioned configuration makes it possible to use a relatively thin or flat main body which, by way of the projecting peripheral limbs, ultimately corresponds at least essentially to the height or thickness of the casement/leaf groove.

A groove is also provided between the respective peripheral limb and the associated angled limb. The limb groove serves ultimately for arranging and positioning a corresponding limb of the further fitting part, which will be discussed in more detail hereinbelow.

The invention also makes provision for the main body to have an elevation between the angled limbs, said elevation forming a free space on the underside. The wall thickness in the region of the free space is preferably the same as elsewhere on the main body. The free space serves essentially to accommodate residues of material from the main body which can be produced for example when a punching screw is screwed in in order to fasten the further fitting part or the connection body.

A preferred configuration of the invention also makes provision for the main body to be of mirror-symmetrical design in relation to its centre longitudinal axis. The mirror-symmetrical design has significant installation advantages, since there is no need, during installation, to pay close attention to the arrangement in which the main body is inserted into the casement/leaf groove.

For the purpose of coupling the drive rod to the connection body of the corner deflection means, provision is advantageously made for the underside of the connection body to have provided on it a foot with at least one engagement protrusion for engaging in the C-shaped groove on the fitting part. Inserting the foot into the C-shaped groove on the drive rod gives rise to a secure arrangement of the connection body and the drive rod. All that then ultimately remains is for the connection body to be fixed to the drive rod at the location provided for this purpose in the groove.

In order to realize a secure connection between the drive rod and the connection body, the foot has, on opposite sides, a respective engagement protrusion for engaging behind the respective angled limb of the drive rod. As a result of the engagement protrusions engaging behind the angled limbs on either side, it is possible to ensure, even under the action of a high level of force, that the connection body is retained securely on the drive rod.

In order for the connection body to be arranged and supported correctly on the main body of the drive rod, it is the case that, on at least one longitudinal periphery, preferably on is both longitudinal peripheries, the connection body has a limb which is angled on the underside or rear side and is intended for arranging in the limb groove between the peripheral limb and the angled limb of the drive rod.

In principle at least one in particular releasable fastening means is provided for the purpose of fastening the drive rod on the connection body, A preferred configuration of the invention makes use, for this purpose, of a screw-connection. In particular, in this context, the connection body has provided in it a screw-connection through-opening for a screw, in particular a punching screw, for fixing purposes. The screw-connection opening here is located preferably in the region of the longitudinal centre axis of the connection body, and therefore, when the connection body is being screwed to the drive rod, the screw acts on the elevation of the main body. In the case of a punching screw, which is provided for punching through the main body; punching residues, which are produced during the screw-connection and punching operations, are then accommodated in the free space beneath the elevation.

For the purpose of installing the fitting parts, the latter are usually inserted into the casement/leaf groove and move towards one another. This can be done by the one fitting part being moved in the direction of the other fitting part, or vice versa. It is also possible, in principle, for the two fitting parts to be moved towards one another, in the case of a corner deflection means, however, it is not possible for the latter to be moved in the direction of the other fitting parts. In this case, the drive rods are usually moved towards the connection bodies of the corner deflection means for connection purposes. For installation purposes, when the connection body is to be fastened on the drive rod, the connection body at any rate is located above the drive rod in the casement/leaf groove.

Irrespective of which fitting part is moved in the direction of the other fitting part, a preferred configuration of the invention provides for at least one end side of the connection body to have provided on it a protrusion which tapers in a wedge-shaped manner towards its free end in a longitudinal direction and/or on its underside and is intended for arranging between the angled limbs of the drive rod. In particular the wedge shape provided in the longitudinal direction of the protrusion can ensure that the main body of the drive rod is centred in the casement/leaf groove, to be precise in particular such that the centre longitudinal axis of the main body runs directly above the centre longitudinal axis of the casement/leaf groove. The wedge shape on the underside of the protrusion ensures that, when the drive rod is being moved in the direction of the connection body, the latter is raised via the slope on the underside of the protrusion, which considerably simplifies installation.

In the case of a preferred configuration of the invention, the foot, the limbs, the screw-connection opening and/or the protrusion of the connection body are mirror-symmetrical in relation to the centre longitudinal axis of said connection body. This facilitates installation in particular for the case where the connection body is designed in the form of a closing mechanism.

In conjunction with the casement/leaf arrangement according to the invention, provision is made for the width of the opening of the casement/leaf groove to be greater than or equal to the distance between the undercut-containing region of the first longitudinal side and the opposite region of the second longitudinal side of the first and/or of the second corner limb. This ensures that, for example when the casement/leaf is arranged horizontally, the corner deflection means can have in particular two corner limbs inserted into the casement/leaf groove in a horizontal plane. Following corresponding movement/displacement of the corner deflection means within the casement/leaf groove such that the undercut is located behind the limb of the casement/leaf groove, and therefore the groove limb engages in the limb groove of the corner deflection means, it is possible, as has been explained beforehand, for the securing means to have the associated securing portion introduced into the interspace between the corner deflection means and the limb of the casement/leaf groove. In design terms, provision is preferably made, in this context, for the depth of the groove of the corner limb to be larger than or equal to the thickness of the securing portion of the pivot lever.

The casement/leaf arrangement according to the invention is distinguished, in particular, in that, when the corner deflection means is in the installed state, the undercut engages behind a limb of the casement/leaf groove, while the securing portion of the pivot lever is arranged in the interspace between the second longitudinal side and the groove limb of the adjacent portion of the casement/leaf groove.

BRIEF DESCRIPTION OF THE DRAWINGS

Further features, advantages and possible applications of the present invention can be gathered from the following description of exemplary embodiments with reference to the drawing and from the drawing itself. All the features described and/or illustrated here form in themselves, or in any desired combination, the subject matter of the present invention, irrespective of how they are combined in the claims or how the latter relate back.

In the drawing:

FIG. 23 shows a perspective view of the fitting arrangement from FIG. 19 with the drive rods pushed in.

DETAILED DESCRIPTION OF THE EMBODIMENTS

Figure 1:
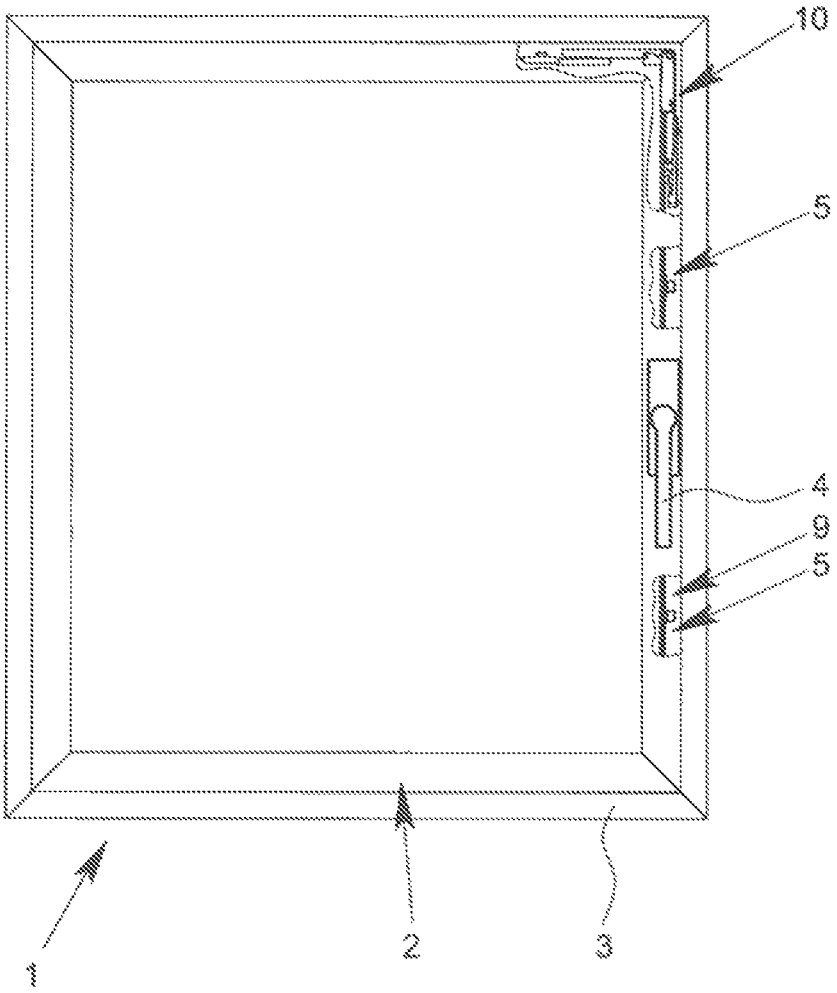
FIG. 1 shows a view of a window, partly in section.
Figure 2:
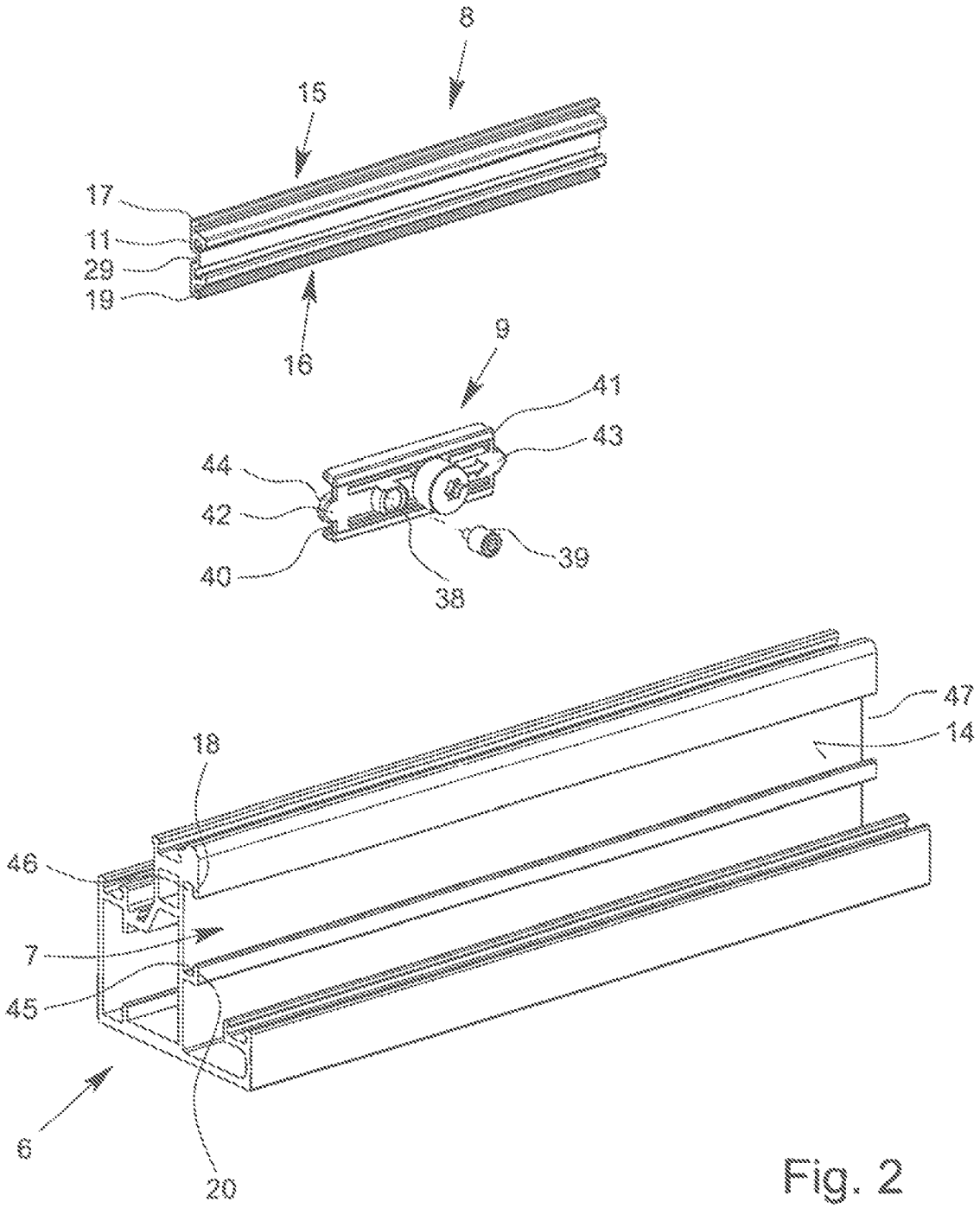
FIG. 2 shows a perspective illustration of part of a frame profile with a fitting part and a further fitting part.

FIG. 1 illustrates a casement arrangement 1 having a window casement 2. The casement 2 is mounted in a pivotable manner on a frame 3. For the purposes of opening and closing the casement 2, use is made of a handle 4, which can be rotated through 90° or 180° from the vertically oriented position illustrated, The handle 4 interacts with a fitting-gear mechanism (not illustrated), which in turn interacts with a fitting 5. The casement 2 has an all-round frame profile 6, which has a C-shaped casement groove 7 which is open in the direction of the frame 3. The casement groove 7 is arranged in the rebate at the frame profile 6 of the casement 2.

In the exemplary embodiments illustrated, the fitting 5, which can be located at one or more locations in the rebate of the frame profile 6 of the casement 2, has at least one fitting part in the form of at least one drive rod 8. The exemplary embodiments according to FIGS. 2 and 6 to 12 provide a further fitting part in the form of a closing mechanism 9, whereas FIGS. 13-35 illustrate a corner deflection means 10.

The fact that the further fitting part may also be designed in the form of a tilt-locking device or a scissor mechanism is not illustrated. What is said here in relation to the closing mechanism 9 and/or to the corner deflection means 10 therefore also applies to other fitting parts with fundamentally different functions and designs. To this extent, what is said hereinbelow in relation to the drive rod 8 and/or the closing mechanism 9 and/or the corner deflection means 10 also relates to other possible fitting parts, which are usually arranged in the casement groove 7 in the rebate of the frame profile 6, even if these other fitting parts are not indicated specifically hereinbelow.

The drive rod 8 has an elongate, flat main body 11 with a front side 12 and a rear side 13. In the installed state, the rear side 13 is directed towards the base 14 of the casement groove 7, The front side 12 of the main body 11 is directed into the rebate or towards the frame 3. On opposite longitudinal sides 15, 16, the main body 11 has a first peripheral region 17 for engaging behind a limb 18 of the C-shaped casement groove 7 and a second peripheral region 19 for engaging behind a further limb 20 of the casement groove 7. The groove limbs 18, 20 have their free ends oriented towards one another.

The essential factor in conjunction with the drive rod 8 is then, first of all, that the front side of the main body 11 has provided on it two spaced-apart angled limbs 21, 22, of which the free ends are directed towards one another. The angled limbs 21, 22, which—as seen in cross section—may also, in principle, be of arcuate design, since ultimately the only important thing is for an undercut to be formed by each of the angled limbs 21, 22, form a C-shaped groove 23 on the main body 11, which is provided for the insertion of the further fitting part into the groove 23.

In addition to the angled limbs 21, 22, the main body 11 has, on the two longitudinal sides 15, 16, a peripheral limb 24, 25 projecting on the front side, wherein the peripheral limbs 24, 25 are provided for engaging behind a limb 18, 20 of the casement groove 7. It is ultimately the case that the longitudinal sides 15, 16 of the main body 11 are angled in order to form the peripheral limbs 24, 25. This means that two angled limbs 21, 22 and two peripheral limbs 24, 25 are located on the front side 12 of the main body 11. A limb groove 26, 27 is formed here in each case between the angled limb 21 and the peripheral limb 24 and between the angled limb 22 and the peripheral limb 25.

An elevation 28 is located on the main body 11, between the two angled limbs 21, 22. A free space 29 is provided on the underside, in the region of the elevation 28. In the region of the elevation 28, the wall thickness of the main body 11 is the same as in the non-elevated region. It is always the case that the main body projects from the base 14 of the casement groove 7 in the region of the elevation 28, while otherwise the rear side 13 of the main body 11 butts against the base.

As can also be gathered from various figures, the main body 11 is of mirror-symmetrical design in relation to its centre longitudinal axis M.

The closing mechanism 9 and also the corner deflection means 10, as a further fitting part, each have a connection body 30, which has a rear side 31 and a front side 32. The rear side of the connection body 30 has located on it a foot 33 with opposite engagement protrusions 34, 35, which are provided for engaging in the groove 23 between the angled limbs 21, 22. It is also the case that, on its opposite longitudinal peripheries, the connection body 30 has a respective limb 36, 37 which is angled on the rear side, wherein the limbs 36, 37 are each designed for arranging in the respective limb groove 26, 27 between the respective peripheral limb 24, 25 and the adjacent angled limb 21, 22.

Furthermore, the connection body 30 has provided in it a screw-connection through-opening 38 for a punching screw 39. This screw-connection serves for fixing the further fitting part on the drive rod 8.

It is also the case that the connection body 30 has a respective protrusion 42, 43 on the two end sides 40, 41. Each of the protrusions 42, 43 is of wedge-shaped design in two respects, that is to say, on the one hand, in and counter to the longitudinal direction of the connection body 30. In this case, the two protrusions 42, 43 taper towards their free ends. Furthermore, it is nevertheless also the case that the protrusions 42, 43 are each provided with a slope 44 on the underside. The protrusions 42, 43 assist the arrangement and correct orientation of the further fitting part on the drive rod 8. In addition, the foot 33, the limbs 36, 37, the screw-connection opening 38 and/or the protrusions 42, 43 of the connection body 30 are mirror-symmetrical.

Figure 3:
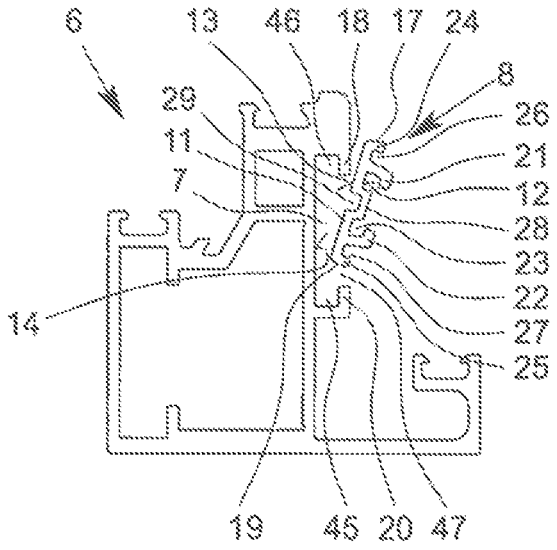
FIGS. 3 to 5 show side views of the frame profile during the operation of inserting the fitting part into the casement/leaf groove of the frame profile.
Figure 4:
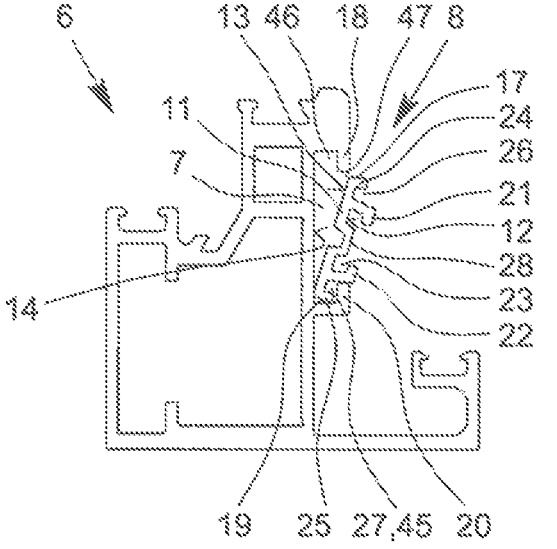
Figure 5:
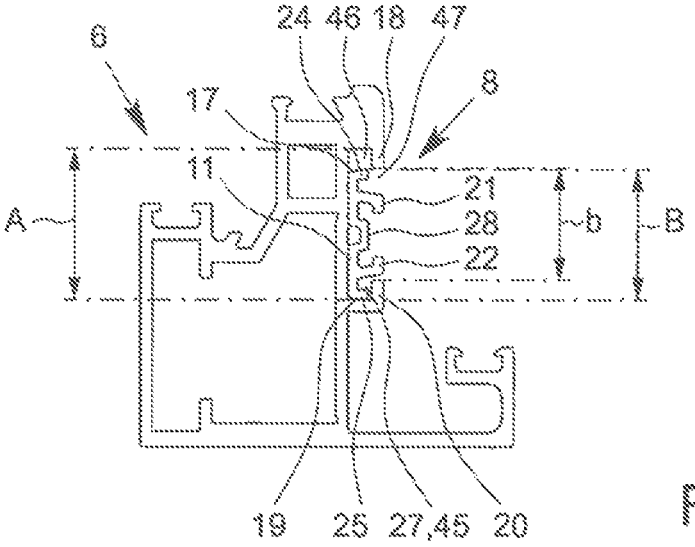

The operation of installing the drive rod 8 in the frame profile 6 is illustrated in FIGS. 3 to 5. The drive rod 8 is installed frontally and, for this purpose, is inserted obliquely into the casement screw 7. In the exemplary embodiment illustrated, the peripheral region 19 is inserted obliquely into the groove portion 45, which is formed by the groove limb 18, as is illustrated in FIG. 4. However, it is also possible, in principle, for the drive rod 8 to be inserted into the groove portion 46 via the other peripheral region 17 and then, unlike the situation illustrated in FIG. 4, pivoted in. The groove opening 47, which is provided between the free ends of the groove limbs 18, 20, has a width b, which is smaller than the width B of the drive rod 8. However, the distance A between the groove base of the groove portion 45 and the groove base of the groove portions 46 is greater than the width B of the drive rod 8. These size ratios ultimately make it possible for the drive rod 8, once placed in position in a groove portion 45, 46, to be pivoted into the casement groove 7, as is illustrated in FIG. 5.

Figure 6:
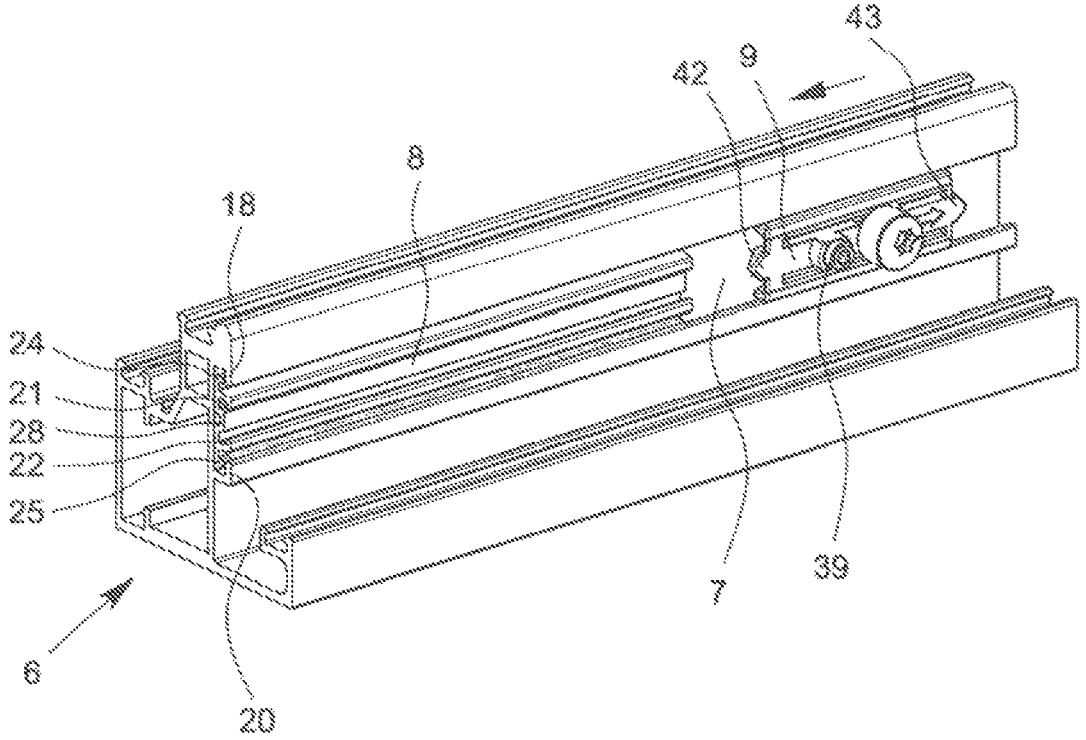
FIG. 6 shows a perspective illustration of part of the frame profile with the fitting part and further fitting part inserted.
Figure 7:
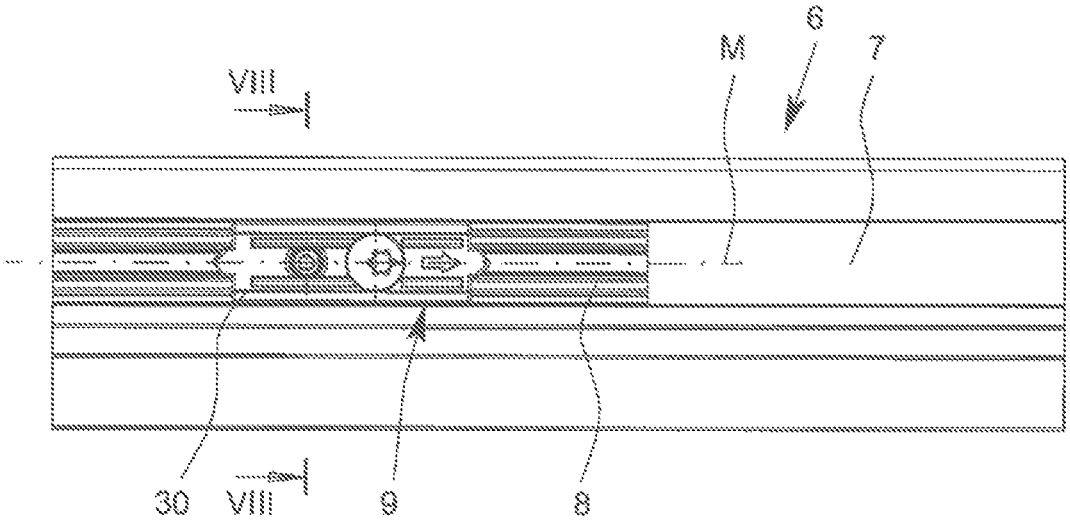
FIG. 7 shows a view of the fitting-part arrangement installed on a preliminary basis in the frame profile.
Figure 8:
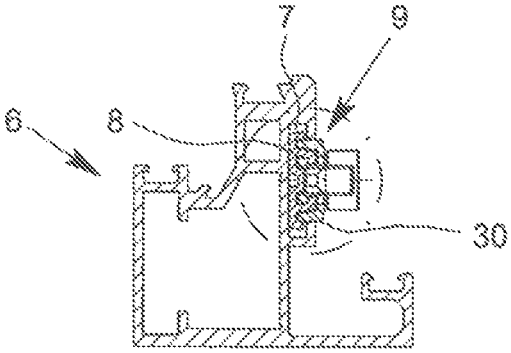
FIG. 8 shows a sectional view from FIG. 7 taken along section line VIII-VIII from FIG. 7.
Figure 9:
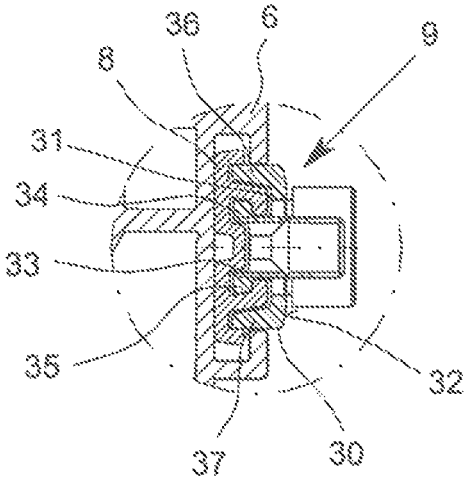
FIG. 9 shows an enlargement of a detail from FIG. 8.

It is usually following installation of the drive rod 8 in the manner described above that the closing mechanism 9 is inserted into the casement groove 7. The closing mechanism 9 here is placed alongside the drive rod 8, as is illustrated in FIG. 6. The operation of inserting the closing mechanism 9 into the opening 47 of the casement groove 7 requires the distance between the outer sides of the limbs 36, 37 to be equal to or smaller than the width b of the groove opening 47. Once the closing mechanism 9 has been inserted into the casement groove 7, the closing mechanism 9 is displaced in the direction of the drive rod 8, as is illustrated in FIG. 6. In contrast to the position illustrated in FIG. 6, the drive rod has the peripheral limb 25 resting on the groove base of the groove portion 45, as is shown in FIG. 5. When the closing mechanism 9 is displaced in the direction of the drive rod 8, the protrusion 42 penetrates into the groove 23 and raises the same within the casement groove 7 and centres the drive rod 8 in the casement groove 7. The slope 44 on the underside of the protrusion 42 makes it easier for the closing mechanism 9 to run onto the drive rod 8. The closing mechanism 9 is then pushed into the desired position on the drive rod 8. This is illustrated FIG. 7. In this state, the limbs 36, 37 of the connection body 30 engage in the limb grooves 26, 27 of the main body 11. Moreover, the foot 33 has its engagement protrusions 34, 35 located in the groove 23, wherein the engagement protrusions 34, 35 engage behind the angled limbs 21 and 22. This is shown in FIGS. 8 and 9.

Figure 10:
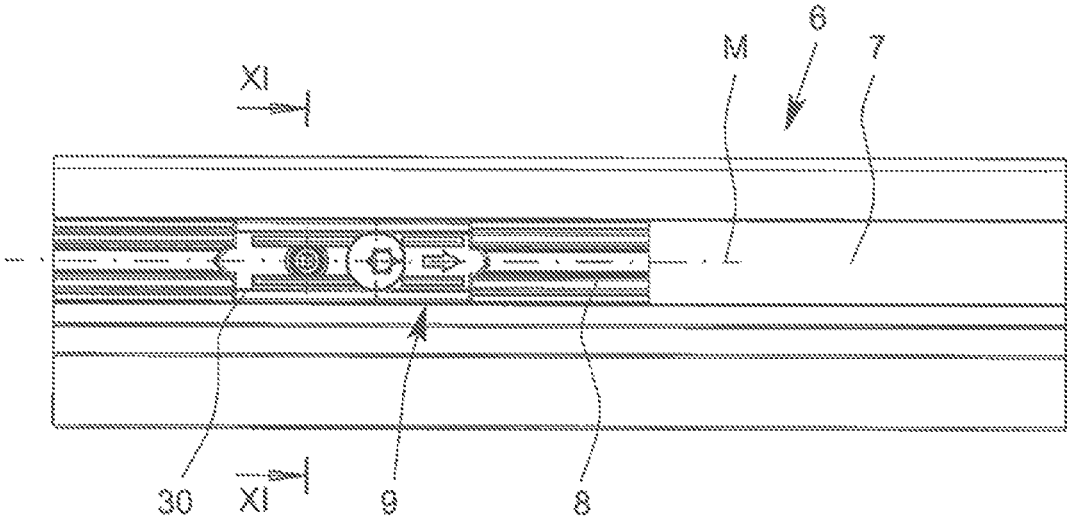
FIG. 10 shows a view of a fitting-part arrangement installed in the frame profile.
Figure 11:
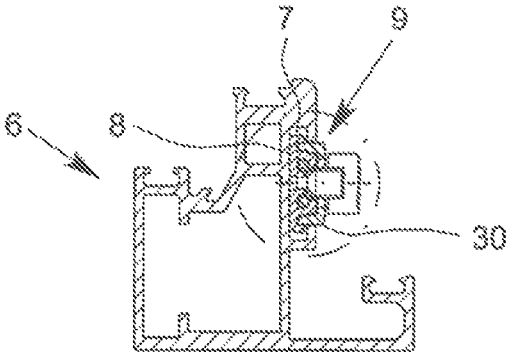
FIG. 11 shows a sectional view taken along section line XI-XI from FIG. 10.
Figure 12:
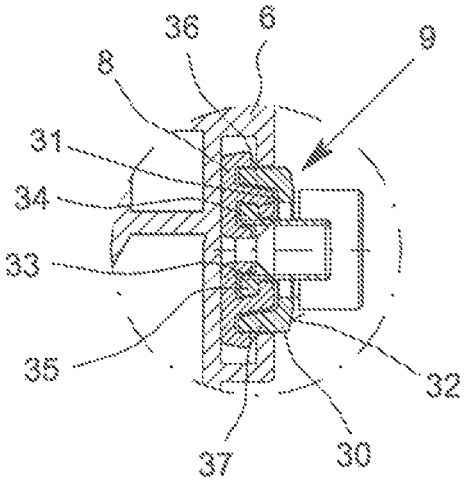
FIG. 12 shows an enlarged illustration of a detail from FIG. 11.
Figure 13:
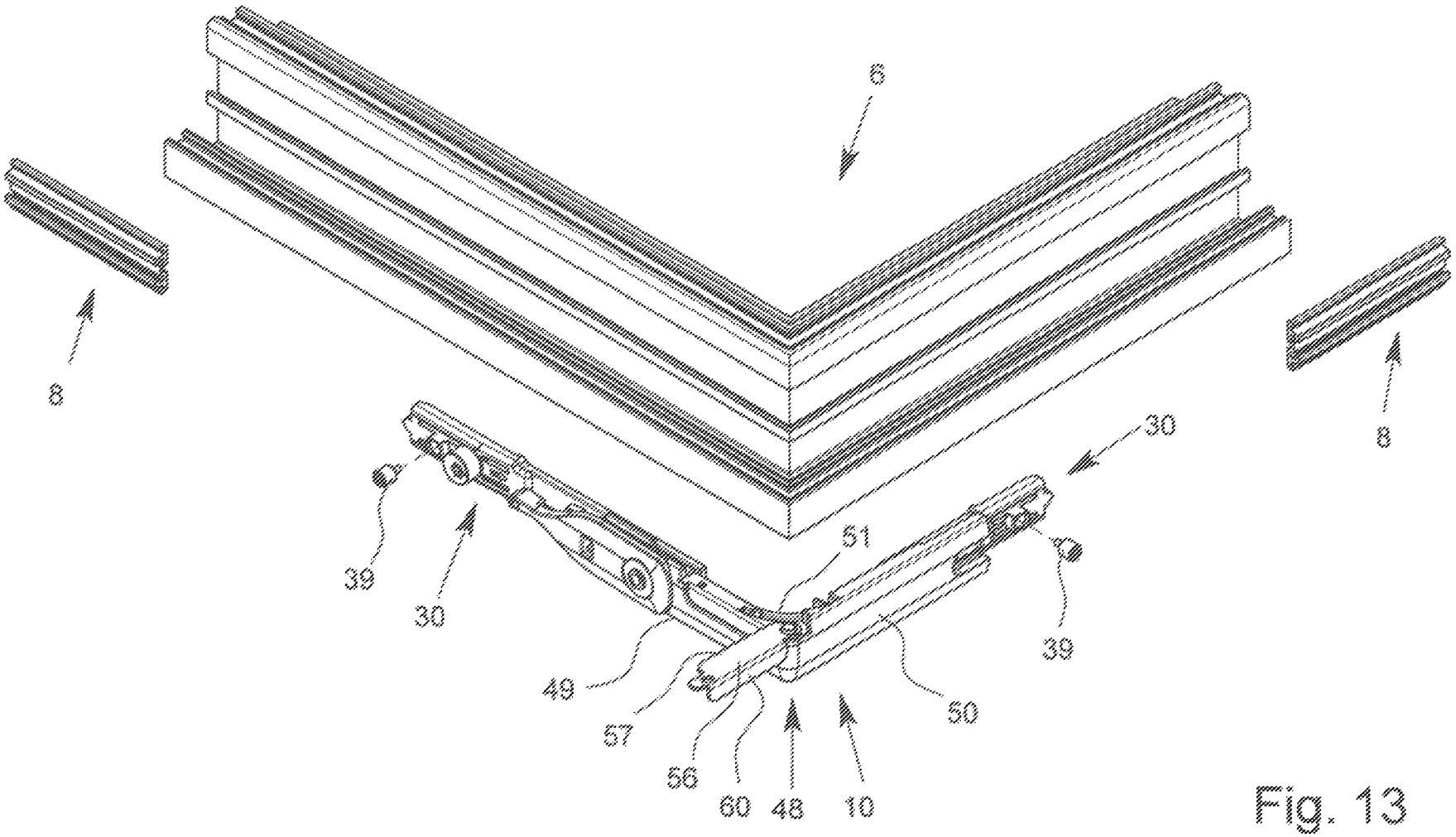
FIG. 13 shows an exploded illustration, in perspective, of part of a casement/leaf arrangement having a frame profile, drive rods and a corner deflection means.

The closing mechanism 9 is then fixed on the drive rod 8 by virtue of the punching screw 39 being tightened, as can be gathered from FIGS. 10 to 12. In particular FIG. 12 shows that the punching screw 39 passes through the main body 11 by way of its end-side punching extension, and this gives rise to a fixed connection between the drive rod 8 and the closing mechanism 9 in the region of the screw-connection. Punching residues which are produced during the punching operation are accommodated in the free space 29 of the main body 11.

It should be noted that it is also possible, in principle, for the closing mechanism 9, rather than being arranged laterally alongside the drive rod 8 and then being pushed onto the drive rod 8, to be placed in position directly on the drive rod 8, the foot 33 being inserted into the groove 23, and the limbs 36, 37 being inserted into the limb grooves 26, 27, in the process.

FIGS. 13-35 illustrate part of a frame profile 6, drive rods 8 which are to be placed in position and a corner deflection means 10. The corner deflection means 10 has a main body 48, which has a first corner limb 49 and a second corner limb 50. The two corner limbs 49, 50 are at right angles to one another. The corner deflection means 10 also has two end-side connection bodies 30. The connection bodies 30 are constructed in functional terms in the same way as the closing mechanism 9. To this extent, reference is made expressly to what has been said above. The two connection bodies 30 are connected to one another via at least one leaf spring 51. In the case of the embodiments illustrated, three leaf springs 51 are provided for the purpose of transmitting the tensile forces and shear forces. The connection bodies 30 can be moved relative to the main body 48.

Figure 33:
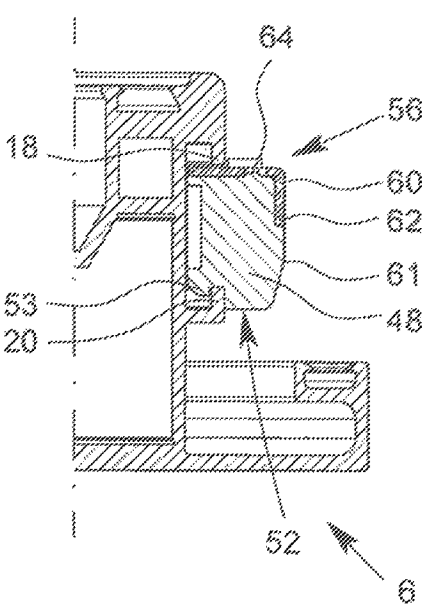
FIG. 33 shows a view corresponding to FIG. 32, but with the corner deflection means secured.
Figure 32:
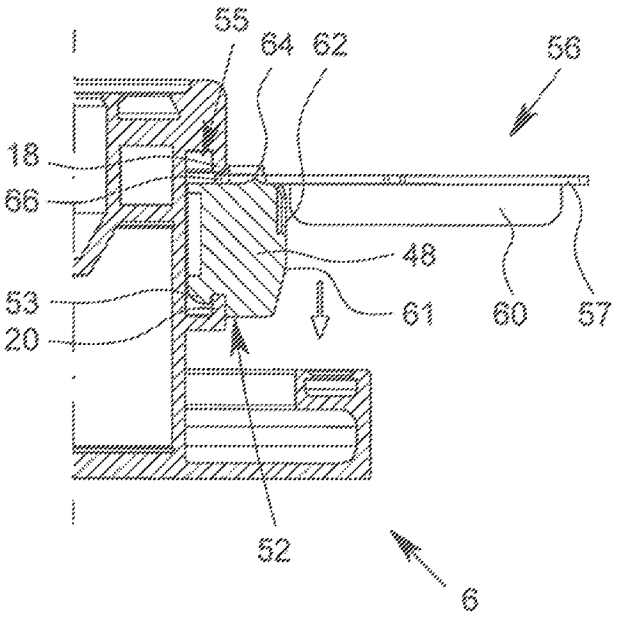
FIG. 32 shows a view corresponding to FIG. 31, but with the corner deflection means pushed into the casement/leaf groove and displaced in the casement/leaf groove, albeit in a non-secured state.
Figure 31:
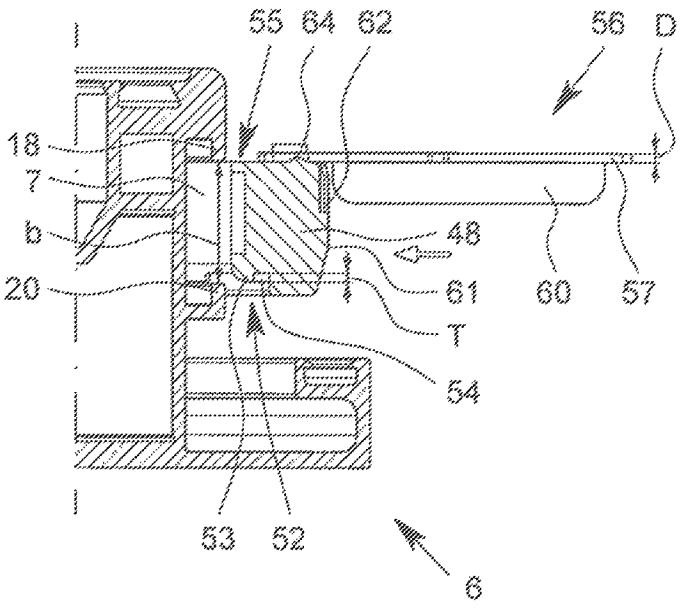
FIG. 31 shows a cross-sectional view of part of the frame profile with the corner deflection means, prior to the corner deflection means being inserted into the casement/leaf groove.
Figures 34, 35:
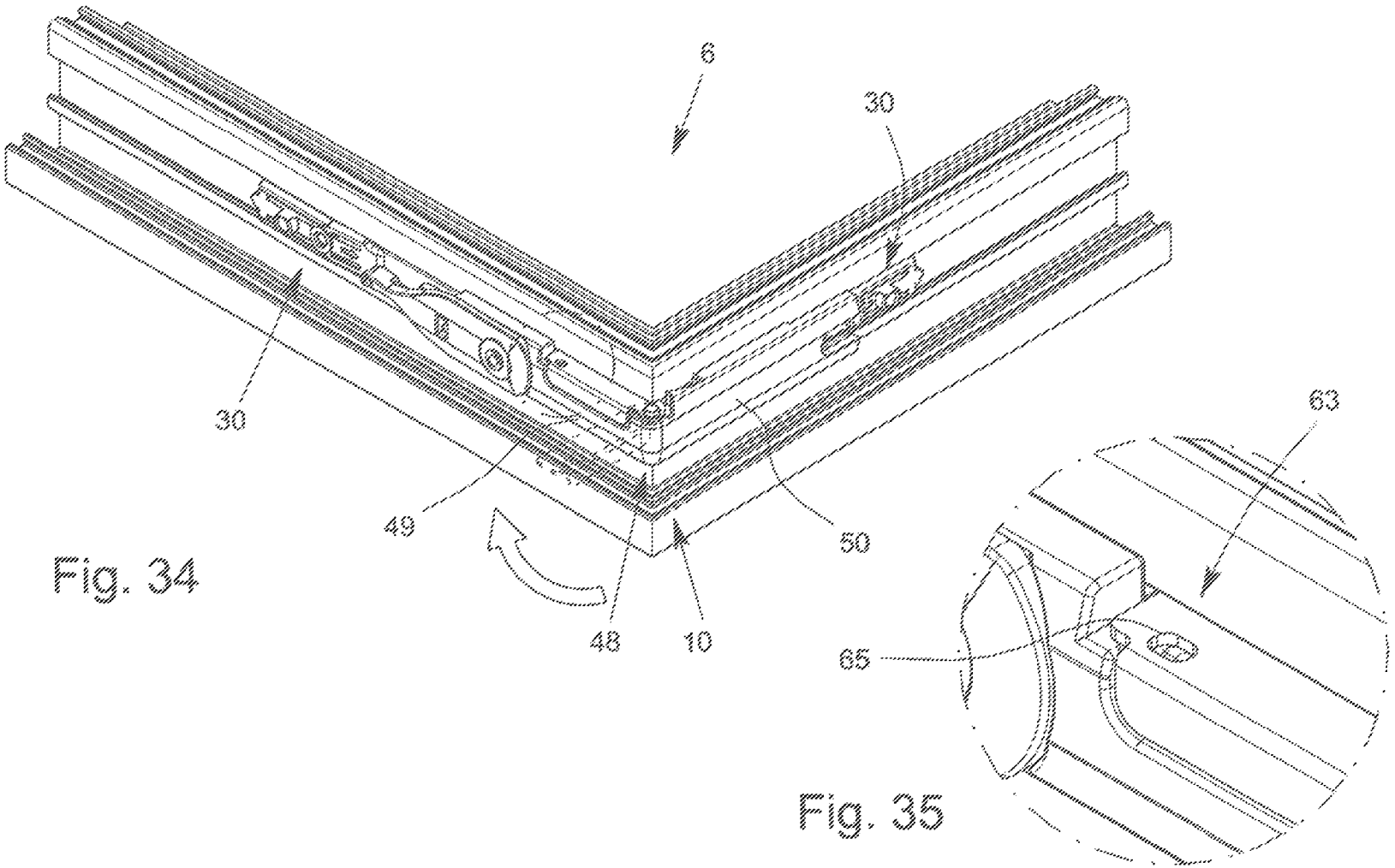
FIG. 34 shows a view of the fitting arrangement corresponding to FIG. 15, but with the securing means located in the securing position and the disengagement position indicated.
FIG. 35 shows an enlarged illustration of a detail from FIG. 34.

In particular with reference to FIGS. 31 to 33, the corner limbs 49, 50 have an undercut 53 on their first longitudinal side 52. The undercut 53 gives rise to a groove 54 for a limb 20 of the casement groove 7.

The essential factor in conjunction with the corner deflection means 10, then, is that that region of the second longitudinal side 55 of the first and of the second corner limbs 49, 50 which is located opposite the undercut 53 of the first longitudinal side 52 is undercut-free. The fact that the second longitudinal side 55 is free of undercut here means, in particular, that there is no effective undercut provided there which engages behind the limb 18 of the casement groove 7 in the installed state of the corner deflection means 10.

In addition, a securing means 56 is provided on the second longitudinal side 55. The securing means 56 can be moved relative to the second longitudinal side 55, and therefore relative to the main body 48, between a securing position, as is illustrated, for example, in FIG. 33, and a disengagement position, as is illustrated, for example, in FIG. 32. In order to simplify matters, not all the details of the main body 48 as such have been illustrated in the cross-sectional illustrations of FIGS. 31 to 33.

The securing means 56 is a pivotably mounted pivot lever with a securing portion 57. The pivot lever is mounted in the corner region 58 of the first and second corner limbs 49, 50 such that it can be pivoted via a pivot-mounting means 59. It is also the case that, in addition to the securing portion 57, the securing means 56 has a stop 60 for delimiting the pivoting movement. The front side 61 of the associated corner limb 49 or of the main body 48 has provided on it a holder 62 in the form of a recess for the stop 60. In the pivoted-in state, that is to say in the securing position, the outer side of the stop 60 is flush with the front side 61 of the main body 48, as can be gathered, in particular, from FIG. 33.

Also provided is an arresting means 63 for arresting the pivot lever in the securing position. In specific terms, the arresting means 63 is designed in the form of a latching connection, wherein the second longitudinal side 55 has provided on it a latching protrusion 64 for interacting with a latching opening 65 in the securing portion 57. It should be noted that, even if it projects from the second longitudinal side 55, the latching protrusion 64 has nothing to do with an undercut in the sense of the invention, since the latching protrusion 64 projects on a region of the second longitudinal side 55 which is not provided for insertion into the casement groove 7 and therefore cannot interact with the groove limb 18.

As can also be gathered from FIGS. 31 to 33. the width b of the opening 47 of the casement groove 7 is slightly greater than or equal to the distance between the first longitudinal side 52 and the second longitudinal side 55 in the region of the undercut 53. It should be noted that the distance relates to that region of the longitudinal sides 52, 55 which is provided for insertion into the casement groove 7. In addition, the depth T of the limb groove 54 of the main body 48 or of the respective corner limb 49, 50 is greater than or equal to the thickness D of the securing portion 57 of the pivot lever.

Figure 14:
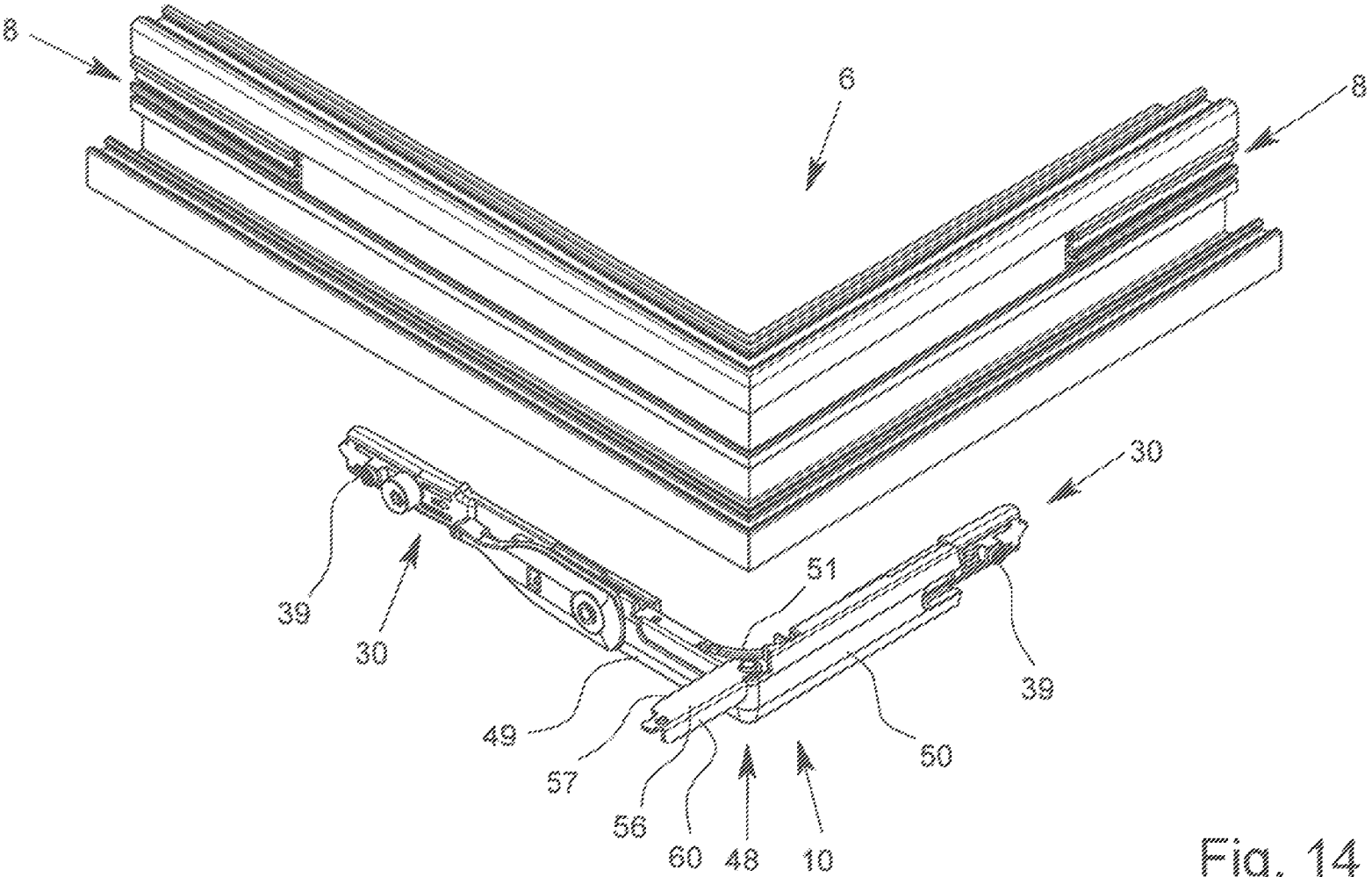
FIG. 14 shows a perspective illustration corresponding to FIG. 13 with the drive rods already inserted, hut the corner deflection means not yet inserted.
Figure 15:
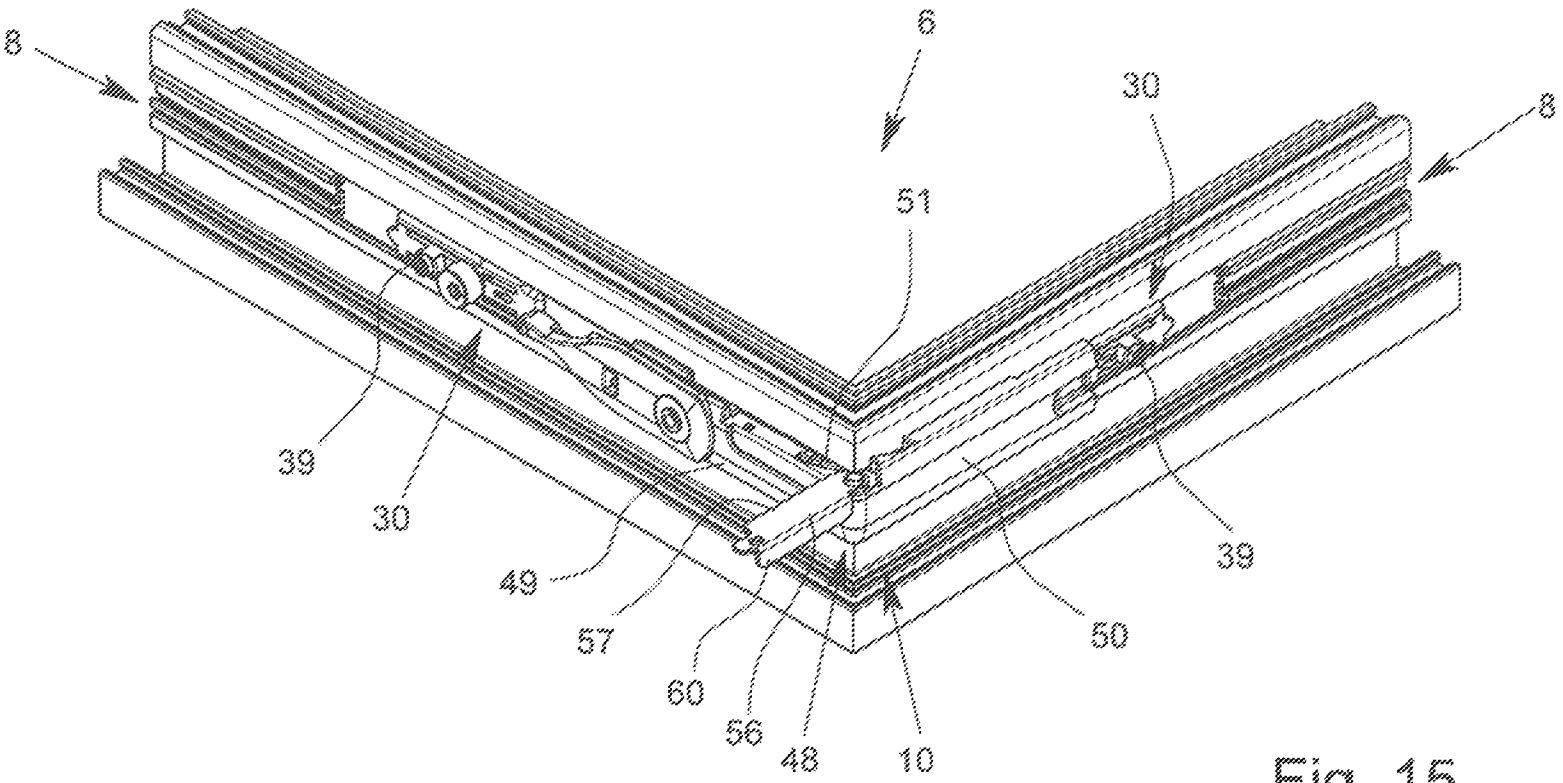
FIG. 15 shows an illustration corresponding to FIG. 14 with the corner deflection means inserted.
Figure 16:
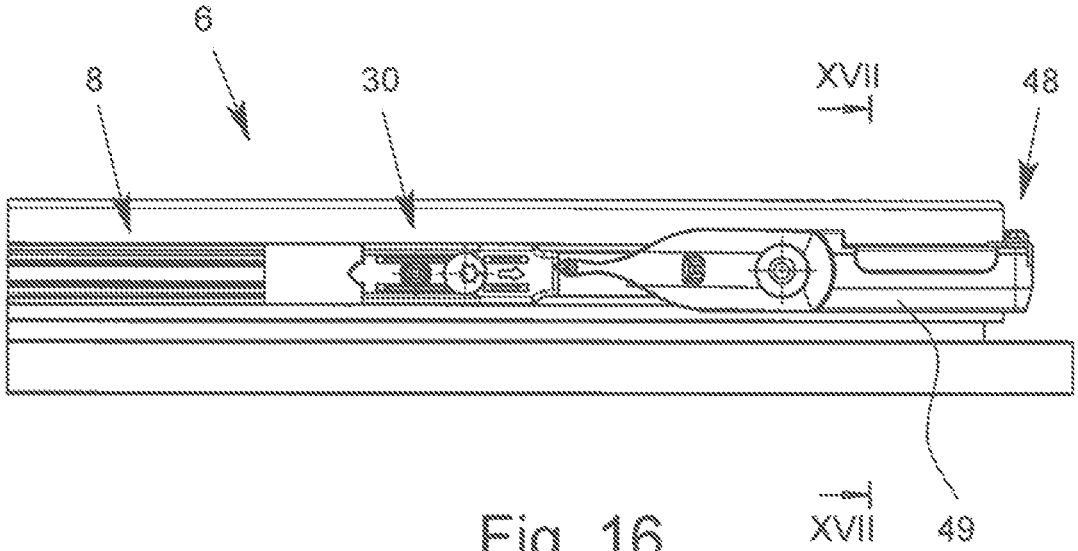
FIG. 16 shows a side view of the fitting arrangement from FIG. 15.
Figure 17:
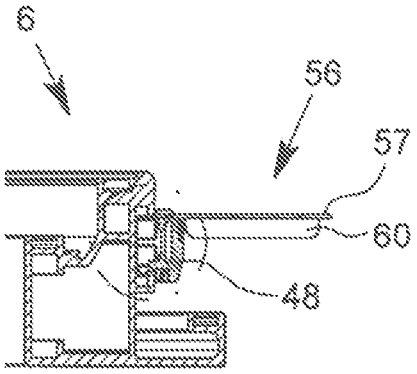
FIG. 17 shows a sectional view of the fitting arrangement from FIG. 16 taken along section XVII-XVII from FIG. 16.
Figure 18:
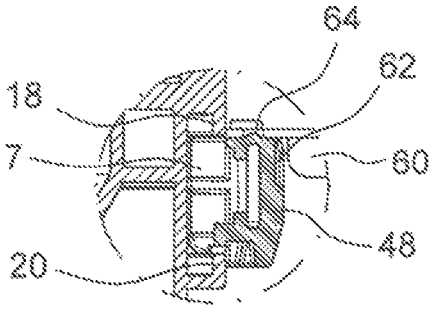
FIG. 18 shows an enlarged view of a detail from FIG. 17.

The operations of inserting the corner deflection means 10 and connecting it to the drive rods 8 will be described in more detail hereinbelow. Proceeding from the situation illustrated in FIG. 13, first of all the drive rods 8 are inserted in the manner described above. This state is illustrated in FIG. 14. The corner deflection means 10 is then placed in position at the corner of the frame profile 6. Since the relevant contours of the two corner limbs 49, 50 are of identical design, it is possible for first the one corner limb or for first the other corner limb to be pushed on or else for the two corner limbs 49, 50 to be pushed on at the same time. FIG. 31 depicts the arrangement of the corner deflection means immediately prior to insertion into the casement groove 7, whereas FIG. 32 shows the main body 48 inserted into the casement groove and already displaced therein.

Figure 19:
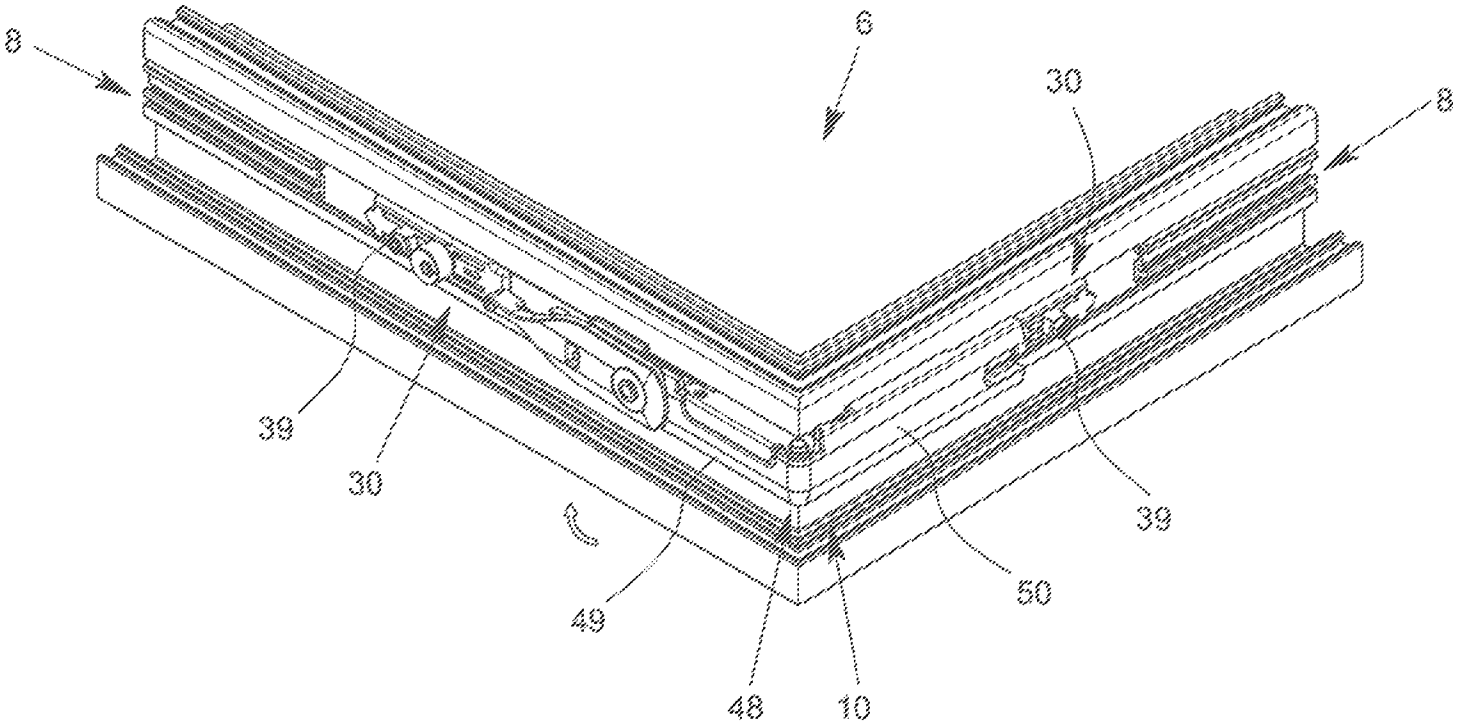
FIG. 19 shows an illustration corresponding to FIG. 15 with the corner deflection means secured.
Figure 20:
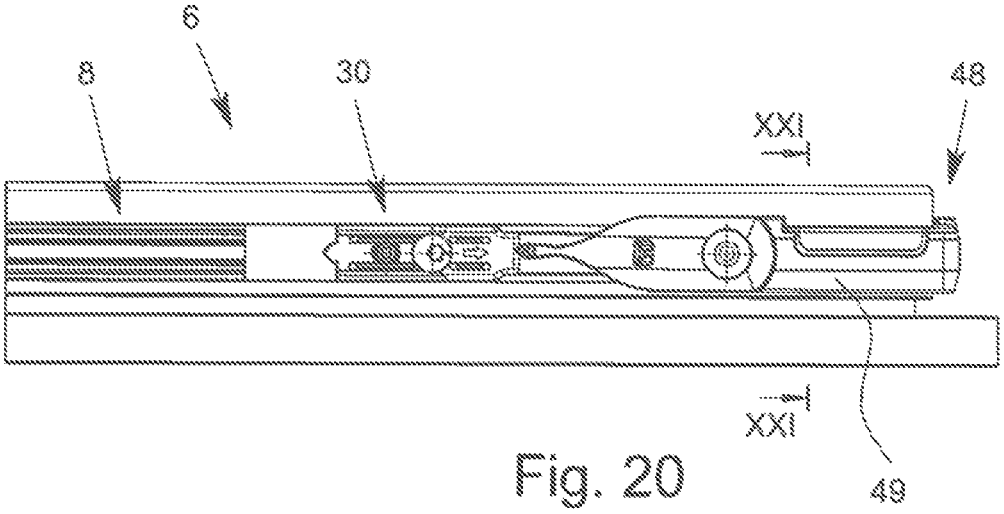
FIG. 20 shows a side view of the fitting arrangement from FIG. 19.
Figure 21:
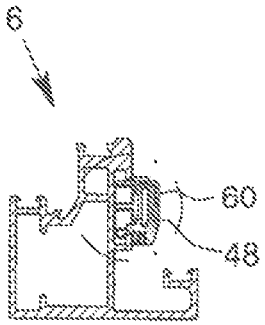
FIG. 21 shows a cross-sectional view of the fitting arrangement from FIG. 20 taken along section line XXI-XXI from FIG. 20.
Figure 22:
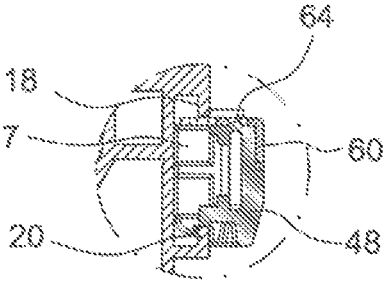
FIG. 22 shows an enlarged illustration of a detail from FIG. 21.
Figure 23:
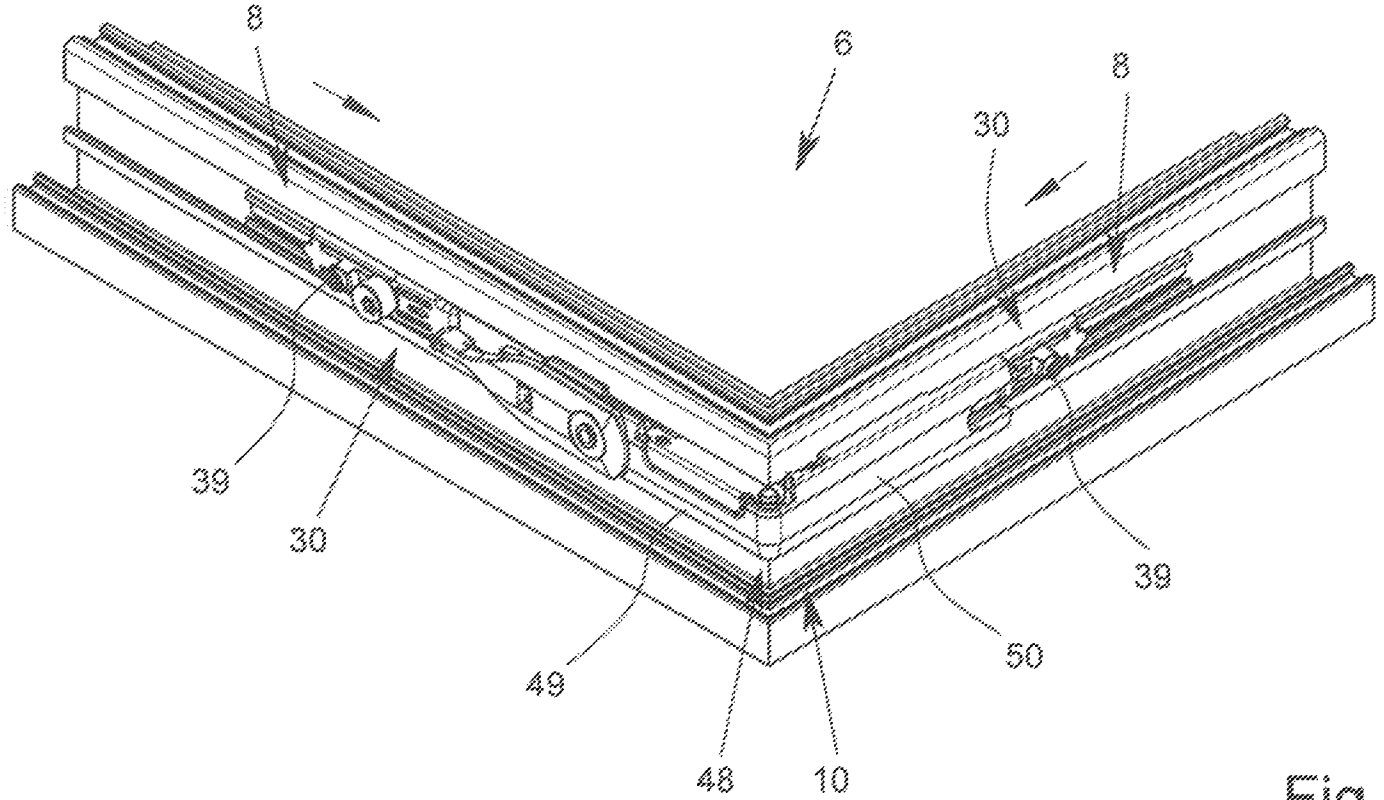
Figure 24:
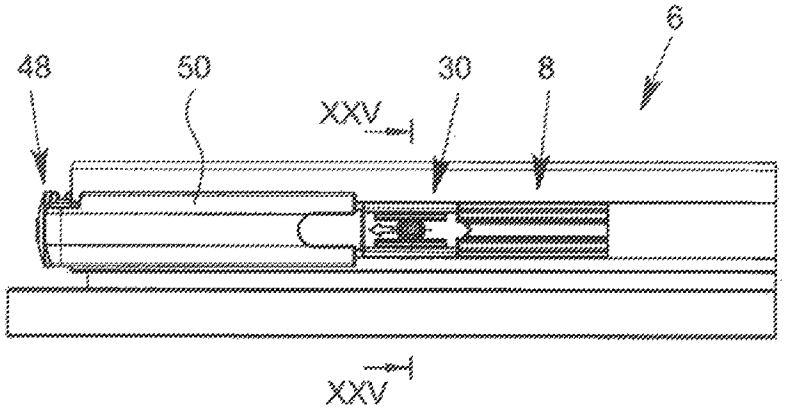
FIG. 24 shows a side view of the fitting arrangement from FIG. 23 with the drive rod as yet unconnected.
Figure 25:
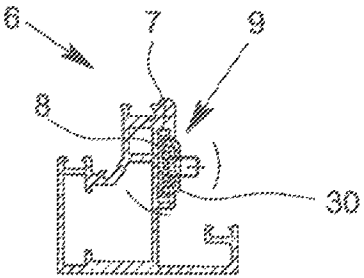
FIG. 25 shows a cross-sectional view of the fitting arrangement from FIG. 24 taken along section line XXV-XXV from FIG. 24.
Figure 26:
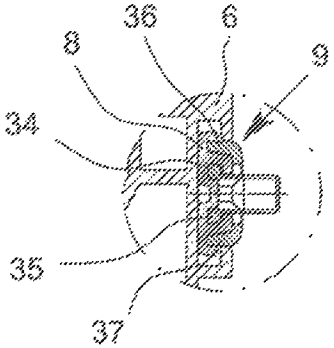
FIG. 26 shows an enlarged illustration of a detail from FIG. 25.
Figure 27:
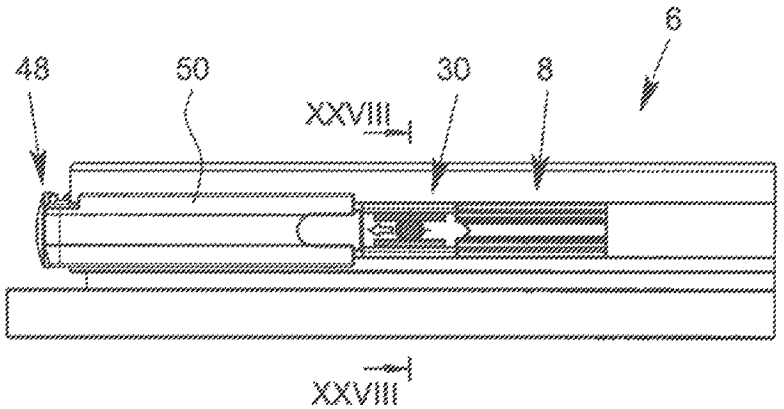
FIG. 27 shows a side view of the fitting arrangement corresponding to FIG. 24, but with the drive rods fixed in place.
Figure 28:
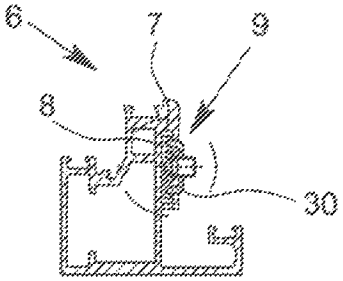
FIG. 28 shows a cross-sectional view of the fitting arrangement from FIG. 27 taken along section line XXVIII-XXVIII from FIG. 27.
Figure 29:
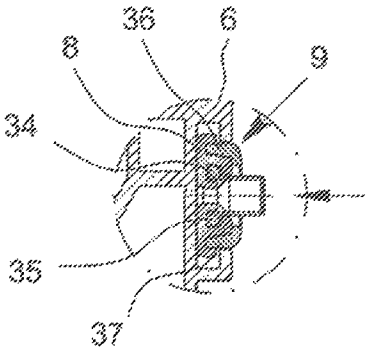
FIG. 29 shows an enlarged illustration of the detail from FIG. 28.
Figure 30:
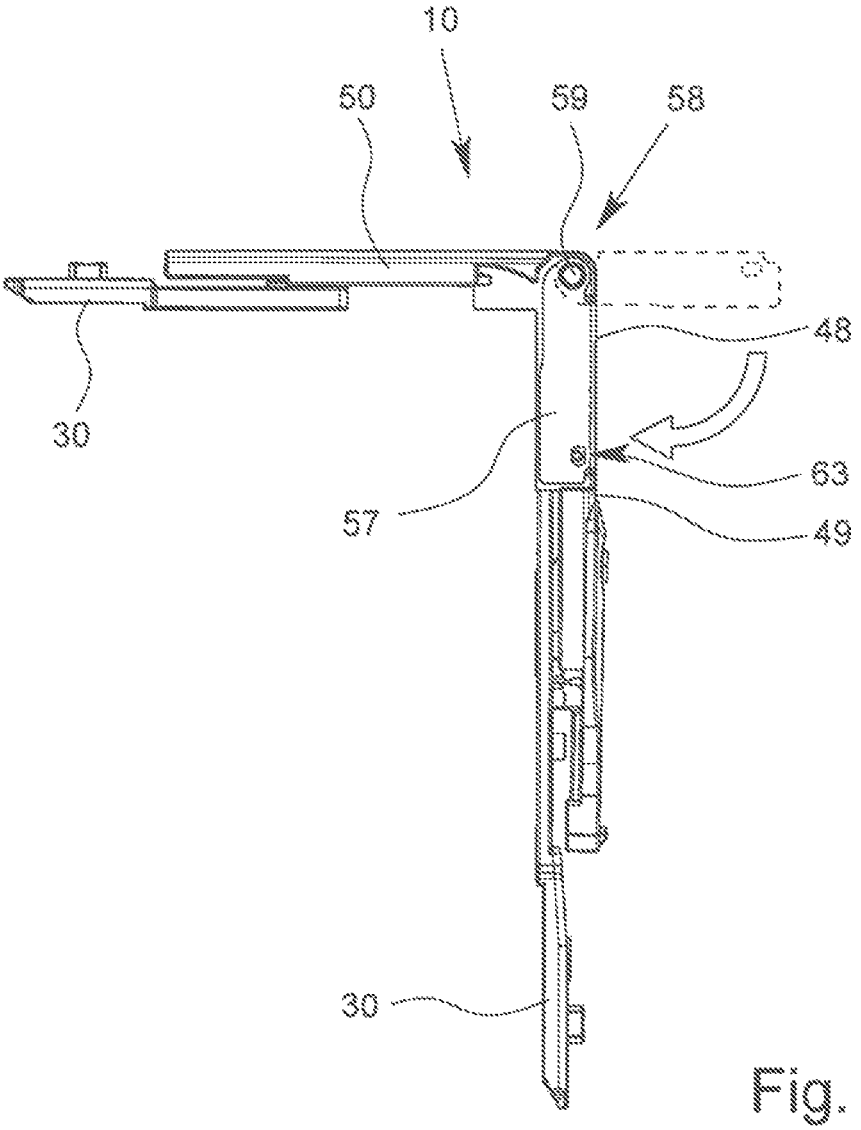
FIG. 30 shows a plan view of the corner deflection means.

Following insertion into the casement groove 7, the main body 48 is displaced in the direction of the groove limb 20 in accordance with the arrow direction indicated in FIG. 32. The groove limb 20 then engages in the limb groove 54, wherein the undercut 53 engages behind the groove limb 20. This gives rise, in the region of the second longitudinal side 55, to a form fit between the main body 48 and the groove limb 20 in the removal direction of the corner deflection means 10. Moving the main body 48 following insertion into the casement groove 7 gives rise to an interspace 66 between the second longitudinal side 55 and the limb 18 of the casement groove 7. The pivot lever has its securing portion 57 pivoted from the disengagement position into the securing position in said interspace 66, as is illustrated in FIGS. 19 and 33. The gap width of the interspace 66 here is equal to or slightly greater than the thickness D of the securing portion 57. In the secured state, the corner deflection means 10 cannot be pushed or raised out of the casement groove 7, nor can it be tilted out of the same. Removal of the corner deflection means 10 from the casement groove 7 by being pushed out is ultimately prevented by the undercut 53 provided on the two corner limbs 49, 50, while the tilting-out or raising action is prevented by the pivoted-in securing portion 57.

LIST OF REFERENCE SIGNS

1 Casement/leaf arrangement
2 Casement/leaf
3 Frame
4 Handle
5 Fitting
6 Frame profile
7 Casement/leaf groove
8 Drive rod
9 Closing mechanism
10 Corner deflection means
11 Main body
12 Front side
13 Rear side
14 Base
15 Longitudinal side
16 Longitudinal side
17 Peripheral region
18 Groove limb
19 Peripheral region
20 Groove limb
21 Angled limb
22 Angled limb
23 Groove
24 Peripheral limb
25 Peripheral limb
26 Limb groove
27 Limb groove
28 Elevation
29 Free space
30 Connection body
31 Rear side
32 Front side
33 Foot
34 Engagement protrusion
35 Engagement protrusion
36 Limb
37 Limb
38 Screw-connection opening
39 Punching screw
40 End side
41 End side
42 Protrusion
43 Protrusion
44 Slope
45 Groove portion
46 Groove portion
47 Groove opening
48 Main body
49 Corner limb
50 Corner limb
51 Leaf spring
52 First longitudinal side
53 Undercut
54 Limb groove
55 Second longitudinal side
56 Securing means
57 Securing portion
58 Corner region
59 Pivot-mounting means
60 Stop
61 Front side
62 Holder
63 Arresting means
64 Latching protrusion
65 Latching opening

66 Interspace
A Distance
b Width
B Width
D Thickness
M Centre longitudinal axis
T Depth

The invention claimed is:

1. A corner deflector of a fitting for a window casement or a door leaf, being inserted into a C-shaped casement groove in a rebate of a frame profile of the window casement or door leaf, the corner deflector comprising a first corner limb and a second corner limb at right angles to the first corner limb; wherein the C-shaped casement groove comprises a limb, the limb of the C-shaped casement groove comprises an undercut and is provided on a first longitudinal side of at least one of the first corner limb and the second corner limb; wherein a region of a second longitudinal side of at least one of the first corner limb and the second corner limb located opposite the undercut of the first longitudinal side is undercut-free; and wherein the second longitudinal side comprises at least one securing element thereon, the securing element is moveable relative to the second longitudinal side between a securing position and a disengagement position.

2. The corner deflector according to claim 1, wherein the securing element is a pivotably mounted pivot lever with a securing portion.

3. The corner deflector according to claim 2, wherein the pivot lever is mounted pivotably in a corner region of the first and second corner limbs.

4. The corner deflector according to claim 2, wherein the pivot lever comprises a stop to delimit a pivoting movement.

5. The corner deflector according to claim 4, further comprising a holder for the stop provided on a front side of one of the first corner limb or the second corner limb.

6. A casement arrangement, having a window casement or a door leaf, comprising a frame profile for the window casement or the door leaf, said frame profile comprising a C-shaped casement groove with at least one groove portion with a groove limb in a rebate; and the corner deflector according to claim 2.

7. The casement arrangement according to claim 6, wherein a width of an opening of the C-shaped casement groove is greater than or equal to a distance between the first longitudinal side and the second longitudinal side in a region of the undercut.

8. The casement arrangement according to claim 6, wherein a depth of the limb groove is greater than or equal to a thickness of the securing portion of the pivot lever.

9. The casement arrangement according claim 6, wherein a free end of each of the first corner limb or the second corner limb comprises a connection body thereon, the connection body connects a drive rod; and wherein a distance between outer sides of limbs of the connection body is equal to or smaller than a width of an opening of the C-shaped casement groove.

10. The casement arrangement according to claim 6, wherein in an installed state of the corner deflector, the undercut engages behind the groove limb of the C-shaped casement groove and the securing portion of the pivot lever is arranged in an interspace between the second longitudinal side and a second groove limb of a second groove portion of the C-shaped casement groove.

11. The corner deflector according to claim 1, further comprising an arresting element to engage the securing element in the securing position.

12. The corner deflector according to claim 11, wherein the arresting element is a latch.

13. The corner deflector according to claim 1, wherein a free end of each of the first corner limb or the second corner limb comprises a connection body thereon, the connection body connects a drive rod, the connection body having a rear side and a front side; and wherein the rear side of the connection body comprises a foot thereon with at least one engagement protrusion to engage a C-shaped groove on the drive rod.

14. The corner deflector according to claim 13, wherein the connection body, on at least one longitudinal periphery, comprises a limb angled in a direction of the rear side to arrange a groove between a peripheral limb and an angled limb of the drive rod.

15. The corner deflector according to claim 13, wherein the connection body comprises a screw-connection through-opening thereon to receive a punching screw to fix the connection body on the drive rod.

16. The corner deflection means according to claim 13, wherein at least one end side of the connection body comprises a protrusion thereon, the protrusion tapers in a wedge-shaped manner towards its free end in a longitudinal direction or on its underside, the protrusion is arranged between angled limbs of the drive rod.

17. A method of installing the corner deflector according to claim 1 in the C-shaped casement groove in the rebate of the frame profile of the window casement or the door leaf, comprising steps of:

frontally inserting the corner deflector comprising two corner limbs into the C-shaped casement groove;

moving the corner deflector such that the undercut engages behind the groove limb of the C-shaped casement groove to provide an interspace between an inserted region of the second longitudinal side of the first corner limb or the second corner limb, and a second groove limb of the C-shaped casement groove; and introducing the securing element into the interspace to secure the corner deflector.

* * * * *